United States Patent [19]

Katzin

[11] 4,273,401

[45] Jun. 16, 1981

[54] ZERO INSERTION FORCE ELECTRICAL CONNECTOR

[76] Inventor: Leonard Katzin, 204 S. Swall Dr., Beverly Hills, Calif. 90211

[21] Appl. No.: 55,682

[22] Filed: Jul. 6, 1979

[51] Int. Cl.[3] ..... H01R 4/58

[52] U.S. Cl. ..... 339/47 R; 339/256 R

[58] Field of Search ..... 339/6 R, 6 A, 47 R, 339/47 C, 248 R, 248 S, 256 R; 24/230 BC, 230 TC

[56] References Cited

U.S. PATENT DOCUMENTS

| | | | |
|---|---|---|---|
| 1,678,166 | 7/1928 | Repay | 339/47 R |
| 3,316,522 | 4/1967 | Demler, Sr. | 339/47 C |

FOREIGN PATENT DOCUMENTS

| | | | |
|---|---|---|---|
| 372860 | 1/1973 | U.S.S.R. | 339/47 C |

*Primary Examiner*—John McQuade

*Attorney, Agent, or Firm*—Fraser and Bogucki

[57] ABSTRACT

A zero or low insertion force electrical connector is provided by a pair of elements which may be fitted together along a longitudinal insertion axis, and then engaged in edge contact relationship at at least two points by a relative pivoting movement. The elements may be fabricated of relatively thin sheets, and have a total thickness corresponding to only two thicknesses of the material. Connectors in accordance with the invention may be made of identical or dissimilar elements, and may include means for preventing out-of-plane shifting of one element relative to the other. Because of the thin edge profile, the elements may be densely packed in a multiple connector, and because of the hinging action the connectors may provide structural support for circuit boards or conductors to which they are coupled, or enable access to circuits for testing under an applied voltage.

37 Claims, 12 Drawing Figures

FIG.8
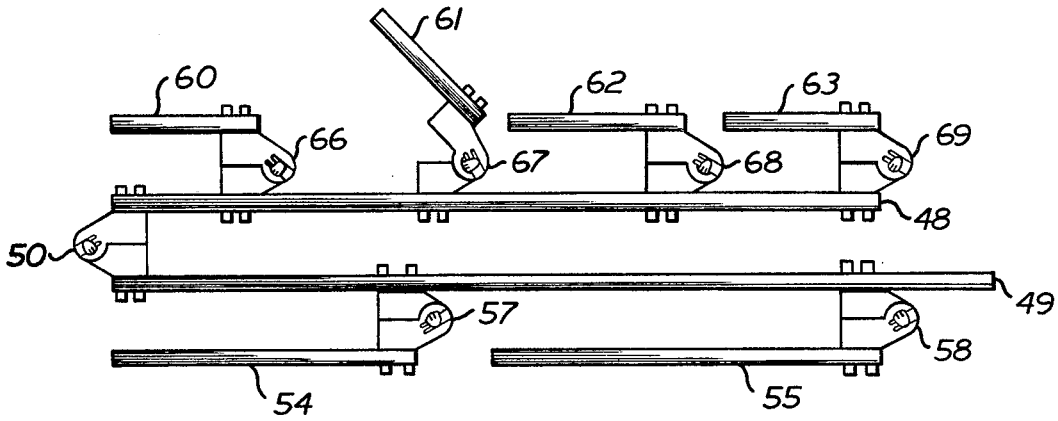
FIG.9
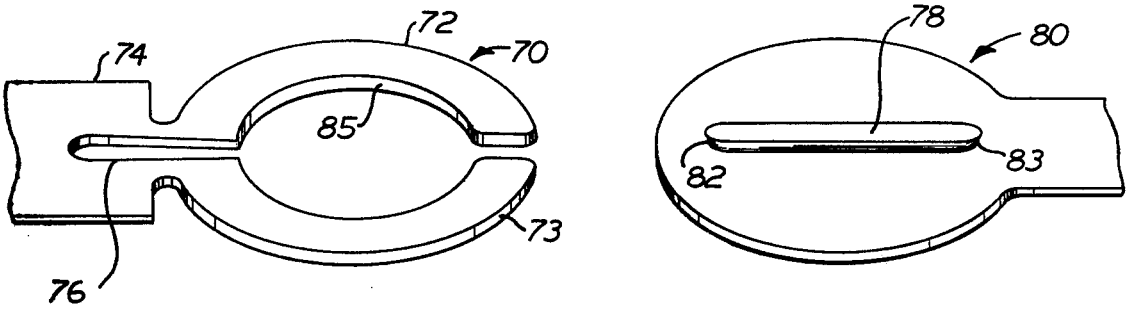
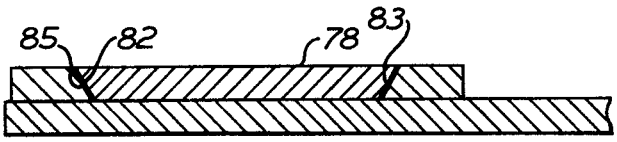
FIG.10

ZERO INSERTION FORCE ELECTRICAL CONNECTOR

BACKGROUND OF THE INVENTION

Detachable electrical connectors have evolved, due to the intricacy and miniaturization of electrical and electronic circuits, into a wide variety of forms for specific applications. Requirements for multiple circuit paths and high reliability have resulted in the adoption of many designs of so-called "zero insertion force" and "low insertion force" connectors. One part of the connector can readily be inserted into the other, without substantial force being exerted, and then the parts can be securely engaged and retained in place with firm electrical contact. Usually, the connectors utilize male plugs insertable into separable female receptacles. The locking action and secure engagement are realized by the use of a separate cam or actuator member that is shifted to provide a levering or wedging effect. A major difficulty with zero insertion force connectors available in the present state of the art is that they are quite expensive, even when manufactured in high volume with consequent economies of scale. Basically, higher costs than desirable are inherent because individual elements are dissimilar, assembly procedures can be complex, and because an extra mechanism is employed to achieve the zero insertion force property. There are, however, other difficulties as well. Assurance of reliable contact is reduced because of oxide deposits, corrosion, or contaminants on the surfaces of the elements. There is some wiping or wedging action between the elements as one is inserted relative to the other, but this does not necessarily clear away built up layers or contaminants, particularly in zero insertion force devices. In addition, electrical pathways tend in any connector to be across point contacts, because minor deviations in contacting surface areas preclude multiple point contact. It is desirable to have a device in which corrosion layers and impurities are wiped free, and in which there are a substantial number of assured points of firm contact between clean metal. While this can obviously be done with complex shapes and mechanisms, it is preferred to utilize a simple, versatile and readily mass produced configuration.

SUMMARY OF THE INVENTION

Connectors in accordance with the invention utilize edge contacts between adjacent planar conductive elements that are insertable along one axis to a mating position and then pivotable or hingable to an engaged position in which a portion of at least one wedges within a spreadable portion of the other. The pivoting movement acts against a spring force that insures reliable edge contact at a number of points, while locking the connector into position. The two principal parts of the connector may be thin, planar unitary elements fabricated out of sheet material, and the entire structure may be substantially only two thicknesses of metal thick. Individual connectors are readily aggregated into compact multiple pin systems and can be utilized in specific geometries of multiple connectors to meet a wide range of requirements.

The two principal elements making up a connector may be hermaphroditic and interchangeable and of such form that they are fabricated and assembled using automatic sequencing. This combination can be configured to guide the two elements into place and then retain them in adjacent planar relation without the use of exterior guides or additional elements. Alternatively the two elements may be asymmetrical, and added means can be incorporated to hold them in adjacent thickness planes.

Further in accordance with the invention, the two halves of hermaphroditic electrical connectors may each have a pair of spaced apart arms and a central insert or tongue, each extending from a common base, but with the arms lying in one plane and the tongue being displaced to an adjacent thickness plane. Electrical connections may be made in conventional fashion to the base of each element. The arms may be asymmetrical relative to each other, with the inner periphery of one being substantially straight and the inner periphery of the other being concave. The outer periphery of the tongue is convex and shaped and sized to provide a wedging action when pivoted within the arms of the adjacent connector half. With elements of like size and shape, the elements mate together with the tongue of one sliding along a longitudinal connector axis between the opening between the arms of the other. As the elements are then pivoted about an axis perpendicular to their principal planes the tongues engage the encompassing arms at a minimum of three points each, both wiping the contact surfaces free during pivoting, and coming into secure contact against the spring resistance of the arms. Depending upon the application, the final hinge or pivot position can provide any desired angle of orientation between incoming and outgoing conductive paths.

Because these hinged connectors can bear substantial loads about the hinge axis, they can be utilized as interconnecting mechanical support elements so as to achieve a variety of circuit board configurations that are both coupled together and readily accessible. Thus circuit boards can be hinged to provide an accordion, or a book, effect that allows access to an individual board while providing high circuit density.

A number of variations can be employed in the connectors themselves. Greater thicknesses of metal can be utilized for high current carrying capacities, the connectors can have precious metal, high conductivity coatings on one or more faces and insulating coatings can be used on the broad faces of the elements. The connector can be single elements, have more than one element lying in a common plane, or can be ganged together so as to lie in parallel planes or be interconnected to a common base.

In other examples in accordance with the invention, the connectors may comprise dissimilar elements, but still be only the thickness of two layers of material and be retained against out-of-plane displacement of one element relative to the other. One member may have only an insertable spreader element receivable and pivotable between deflectable arms of the other member. In this event both the spreader member and deflectable arms may have mating surfaces, such as beveled edges, which prevent the members from becoming displaced in one direction. In another example, the spreader member may act against one set of deflectable arms which in turn acts against other, encompassing, arms, thus increasing the number of contact points avilable in a non-hermaphroditic connector.

BRIEF DESCRIPTION OF THE DRAWINGS

A better understanding of the invention may be had by reference to the following description, taken in conjunction with the accompanying drawings, in which:

FIG. 8 is a side view of a different circuit board configuration using hinged connectors in accordance with the invention;

FIG. 9 is a perspective exploded view of a different electrical connector in accordance with the invention;

FIG. 10 is a side sectional view of the connector of FIG. 9;

DETAILED DESCRIPTION OF THE INVENTION

Figure 1:
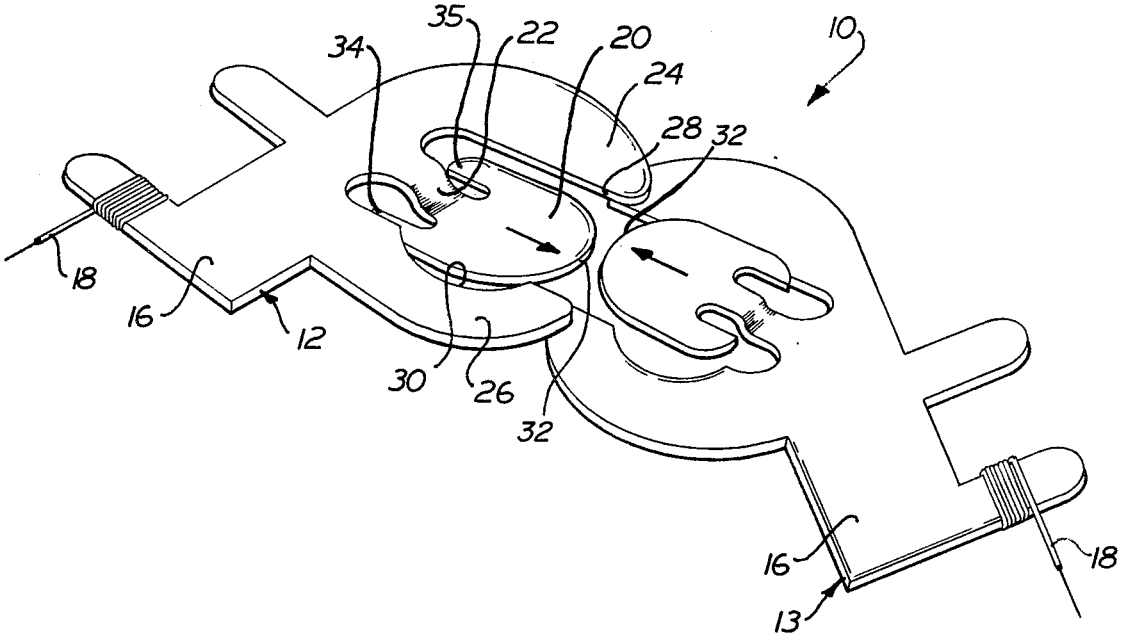
FIG. 1 is a perspective exploded view of a connector comprising two elements in accordance with the invention.
Figure 3:
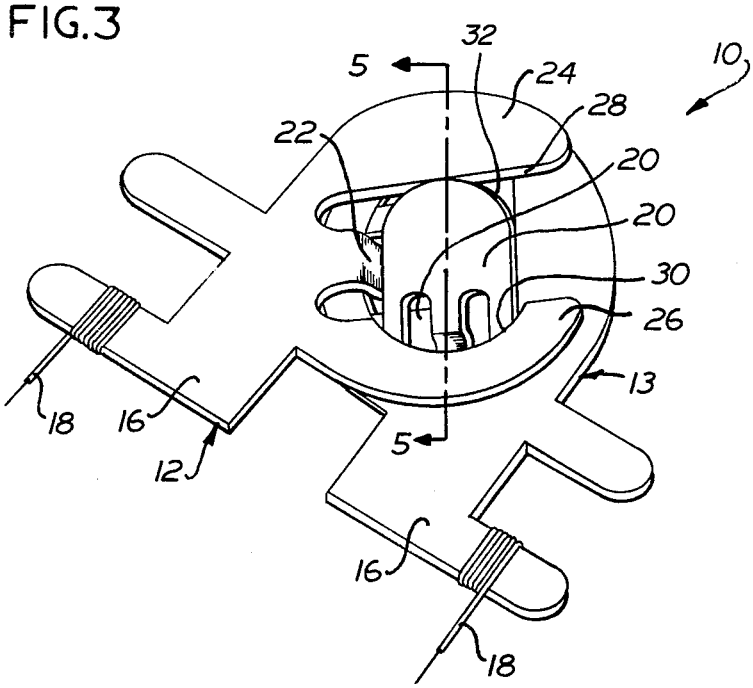
FIG. 3 is a perspective view of the arrangement of FIG. 1, showing the elements in connected and locked position.
Figure 2:
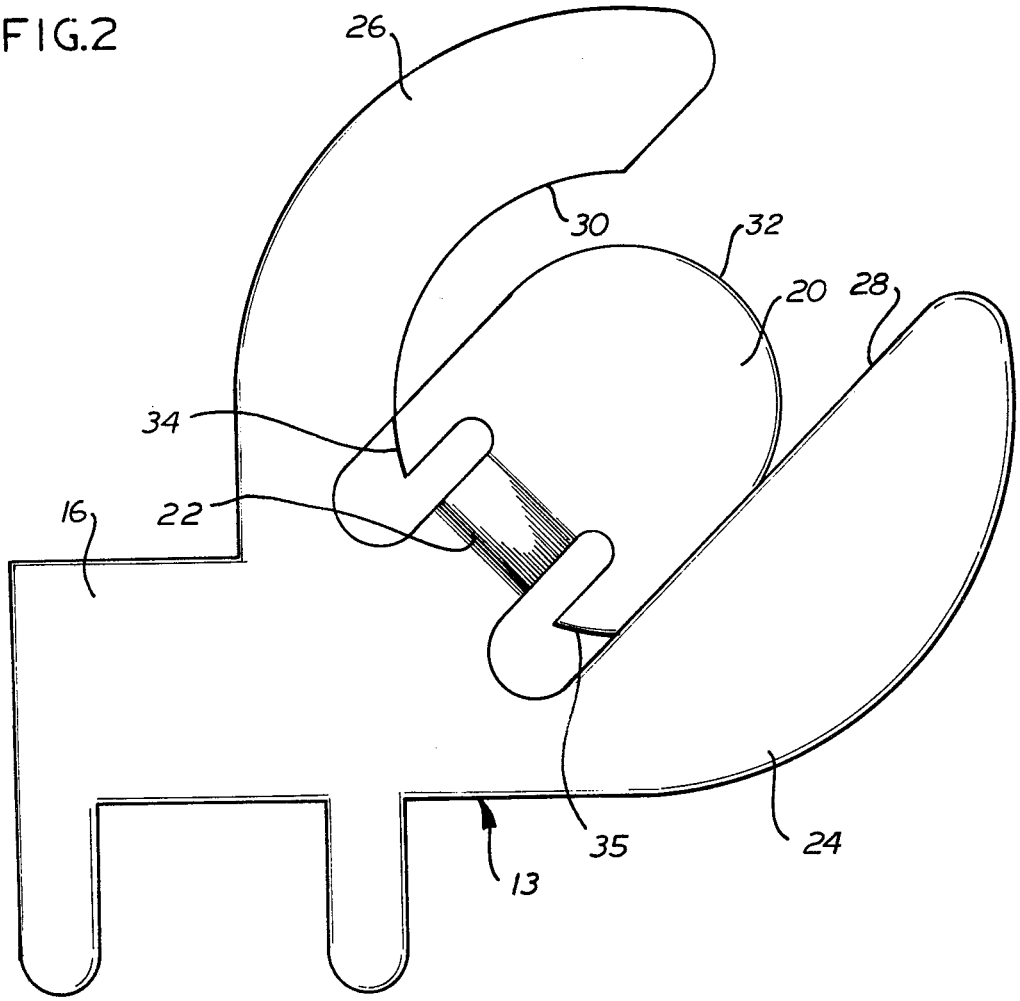
FIG. 2 is a plan view of one of the elements of FIG. 1.
Figure 5:
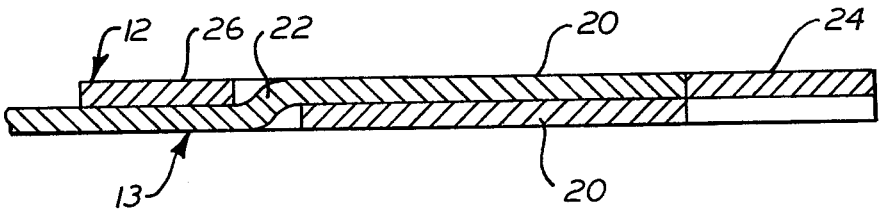
FIG. 5 is a side sectional view of the arrangement of FIGS. 1–4, taken along the line 5—5 in FIG. 3 and looking in the direction of the appended arrows.

A single electrical connector 10 using a separable hinge relation in accordance with the invention and having a substantially minimum thickness is depicted in the drawings of FIGS. 1–5. In this example, the connector 10 is defined by two elements 12, 13 that are identically sized and shaped, and that fit in mating relation so that they may be described as hermaphroditic in character. The elements may thus be interchanged in position and manufactured by the same tooling. The example is intended to show a device suitable for a wide range of current carrying applications, particularly for modern semiconductor circuits. Each of the two elements 12, 13 is fabricated from a sheet of relatively thin material (e.g. 0.015" to 0.020" thickness at a minimum). For purposes of ease of visualization, the elements have not been drawn to scale, particularly as to thickness in the Figures. The metal employed may be brass, copper or other conductive material, but it should be noted that more expensive and critical materials having high spring force properties are not required because of the configuration that is described below. Where there may be numerous openings and closings of the connector a soft or deformable material, e.g. lead, is typically not suitable.

Each half 12, 13 of the connector has a base 16 to which an external wire 18 may be coupled by soldering, wire wrap, welding, insulation piercing for automated mass termination or other conventional means. Taking either half 12 or 13 of the connector 10 by way of example, and recognizing that the same description applies to both halves, it comprises an essentially planar element that may be fabricated simply by a progressive stamping or punching sequence. By "essentially planar" is meant an individual element whose thickness is only a small fraction of the dimensions of the element in its principal plane. Because the element may in fact have a portion that is offset into an adjacent and parallel plane, the total connector thickness is twice that of the sheet material that is used, but it is nonetheless properly referred to as planar because of its extreme thinness relative to its other dimensions. The connector may be said to occupy only two adjacent thickness planes of the material that is employed.

In the example of FIG. 1, the offset portion is a tongue or tab 20 extending from a central region of the base and lying in the plane of the adjacent thickness of material. In this example the tongue 20 is integral with the base 16 and the offset is defined by an angled coupling segment 22. In the principal plane of an element 12 or 13, the base extends into a pair of integral tangs or arms 24, 26 of dissimilar shape in this example. The root portion between the central region of the base 16 and each arm 24 or 26 functions as a slightly deflectable segment or spring portion to permit limited outward displacement of the arms in the principal plane of the connector 10. That is to say, the deflecting force has to act along the plane of the element and thus acts against the greatest possible resistance afforded by the thin sheet material. It will be noted that the material need not have a high spring constant to exert a high spring force in resistance to deflection, and that the element when deflected need not even remotely approach the deformation point of the material.

Figure 4:
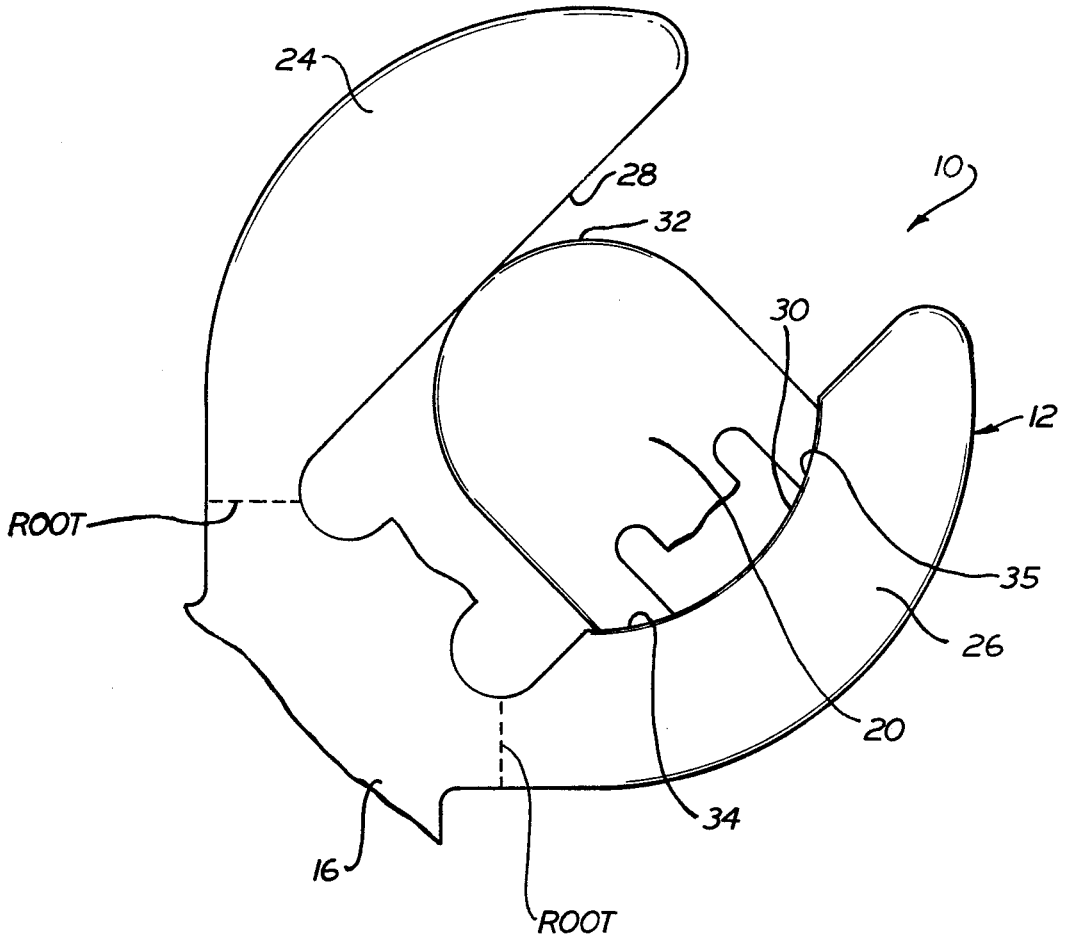
FIG. 4 is a simplified fragmentary plan view of the arrangement as shown in FIG. 3, illustrating the points of contact and the spring effect in greater detail.

A first of the arms 24 has an essentially straight inner edge 28 which serves in this example as a reference surface in the hinging action that is used in locking the connector. The second arm 26 has a concave inner edge 30 displaced from the opposing edge 28 in accordance with the size and shape of the tongue of the mating connector half. In the hermaphroditic connector 10 as shown in FIGS. 1–5 each of the tongues fits between the arms of the opposing half of the connector. For ease of reference, the longitudinal axis of a connector half 12 or 13 may be considered to extend from the base 16 centrally of the tongue 20 and between the arms 24, 26, along the direction of the arrows in the exploded view of FIG. 1. The transverse dimension of the tongue 20 is insertable along the longitudinal axis with at least a sliding fit between the terminal portions of the arms 24, 26 of the opposite connector half. The opposed parallel surfaces at the terminal portions of the arms 24, 26 and the outer edges of the tongue provide guiding for insertion of the elements into mating relation along the longitudinal axis of insertion. The forward insertable end 32 of a tongue 20 is an approximate arc of a circle, and the tongue 20 extends rearwardly therefrom along sides that are straight or at least have less curvarture to rear bearing surfaces 34, 35. As seen in FIG. 4, the concave inner edge 30 is spaced and configured relative to the opposed inner edge 28 to provide a spacing such that the tongue 20 wedges between the arms 24, 26 when pivoted about an axis normal to its plane through a selected angle, here about 90°. Stated in another way, the length dimension of the tongue, which may also be termed a spreader member, is slightly greater than the transverse dimension between the arms, relative to the longitudinal axis. However, these relative dimensions cannot be measured directly along the particular axes in the case of three point contact, and must be taken along lines centered about the applicable reference line or axis. Between the base 16 and each of the arms 24, 26, the spreading forces act most strongly at the narrowed root portions.

In the example of FIGS. 1–5, as best seen in FIG. 4, a short arc of the tongue 20 (in the curved forward portion 32) and each of the rear bearing surfaces 34, 35 are in contact with one or the other of the arms 24, 26 when the elements have been pivoted to locking position about an axis normal to the plane of the elements. Thus there are three points of contact for each tongue 20, and in the hermaphroditic type of connector 10 there are six total points of edge contact. By using the spring effect of the arms 24, 26 the contact is assured and positive because pressure is maintained by the spring force resistance. Furthermore, because pivoting of one connector 12 relative to the other 13 provides wiping of the edge surfaces of each tongue relative to the edge surfaces of the other connector, corrosion and particulates are cleared off the surface and the contact is enhanced. The use of asymmetrical arms 24, 26 increases the resistance to vibration and shock, because the two arms 24, 26 have different masses and shapes. The use of the root section of each arm as a spring, in the direction of the plane of the sheet material, is particularly advantageous, because only a low deflection is required for a relatively high spring force, and there is no likelihood of permanent deformation of the spring.

It should also be noted that the halves 12, 13 of the connector 10 may be arranged to provide a variable force during the hinge locking action. When each tongue 20 is inserted between the opposed arms, it enters linearly, with essentially "zero force" required and is guided on axis into position. However, when it reaches the limit of its insertion travel, at which the pivot or hinge action about the axis normal to the plane may commence, the concave inner surface 30 provides a maximum spacing from the opposing edge surface 28. Thus little or no resistance force is encountered at the start but as the pivot arc increases the resistance force likewise increases until the locking position is reached. This provides a secure locking action without the use of a separate actuator element and enables the locking position to be well defined. A detent arrangement or a stop member (not shown) may be utilized to limit the extent of pivot and insure placement at a predetermined final location. However, this is not required, and if desired it may be provided by an external stop, particularly in a multi-connector system. Detents and limit stops can be included on edge surfaces or on surface planes, as desired.

The hermaphroditic connector also locks the connector halves 12, 13 in the transverse direction relative to the principal plane, so that the elements do not shift out-of-plane, because the facing tongues 20 are interlocked against relative movement in either direction along this axis. The facing surfaces of the tongues 20 are in contact, but this contact is not relied upon to make electrical connection, because little pressure is applied and because adequate electrical contact is made at the six connector points along the edges.

It will be appreciated by those skilled in the art that it is sufficient to have two contact points per tongue, for many applications, inasmuch as it is only required that there be two points to exert a spreading force on the facing arms. The three point system is a stable system, however, and is achieved without complicating the structure. It will also be appreciated that the planar surfaces of the connectors 12, 13 may be coated with an insulating material prior to punching, so that only the opposed edges provide bare metal contact. In the elements shown, all parts are integral with the base, and although this will usually be preferred the elements can obviously be assembled from different parts. In addition, the profiles of the tongue and arms can be substantially varied so as to include the additional material or eliminate material, depending on particular system configurations and requirements. Because only edge contact is relied upon the bodies of the elements can be of synthetic resin, and therefore injection moldable. If this type of construction is used the conductive edges can be provided by plating, conductive edge inserts and the like.

Techniques for strengthening the elements 12, 13 may also be employed, such as using corrugations or dimples to prevent bending or deformation of parts of the structure in the event of accident or careless use. It is also evident that a hermaphroditic structure need not be used, even though the same general interlocking relationship is used For example, the dispositions of the interlocking elements or the bases can be substantially changed, so that the bases of the connectors 12, 13, when in the locking position, can be adjacent, at a 90° angle, or extend in opposite directions along a given axis. Thus wire conductors can be interconnected whether they approach each other at 180°, at 90°, or are parallel and adjacent, or any angle between 0° and 180°.

Figure 6:
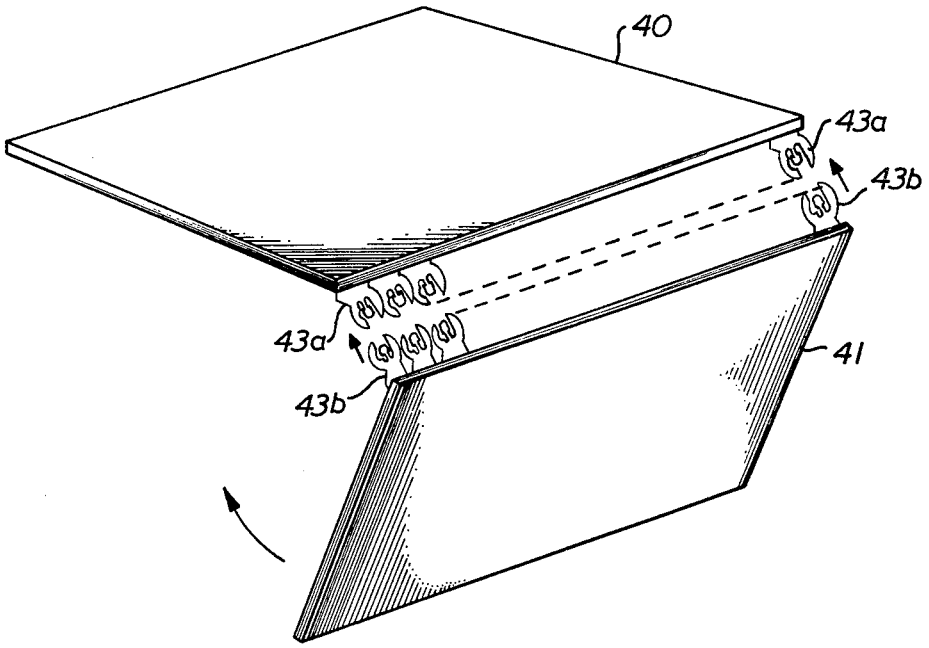
FIG. 6 is a plan view of a circuit board configuration using hinged connectors in accordance with the invention.
Figure 7:
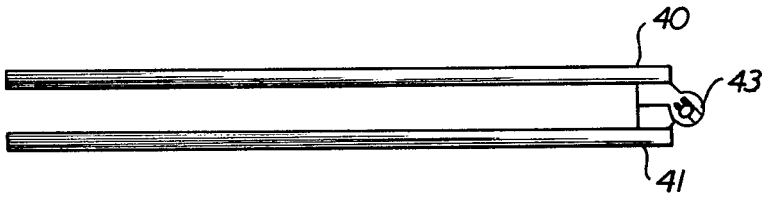
FIG. 7 is a side view of the arrangement of FIG. 6.

This versatility of the connector, together with the fact that the connector itself can be a load-bearing element when locked in the contact position, enables usage in a wide variety of system configurations. For example, as shown in FIGS. 6 and 7, the side edges of circuit boards 40 and 41 may be coupled together solely by a series of spaced apart connectors 43, each made up of half elements **43*a* and 43*b* and spaced apart along the edge of each board. The circuit boards 40, 41 are thus held solely by the connectors 43 in spaced apart, facing relation. Alternatively, the connectors 43 may be mounted and configured so that when the contacts are active (in the conducting position), the boards 40, 41 are coplanar, and define an angle of 180° relative to the central hinge axis. It is evident also that the connectors 43 can be positioned and angled such that with the boards coupled together at the hingle axis, access to circuits and components can be had without completely unhinging the boards 40, 41. The typical mother-daughter board arrangement can also be realized, with multiple daughter boards being mounted on edge from a common mother board. The only device known to function as a hinge and electrical connector is described on page 58** of *Computer Design* magazine for March 1967. That device, however, relies on flat surface contact between adjacent elements and is not an engageable type of connector, being similar to a piano hinge construction.

It will also be evident that by mounting hinge connectors along the same or opposite ends of circuit boards, an array of closely spaced circuit boards can be densely packed in self supporting fashion. An example of the versatility of the system is shown in FIG. 8, in which a pair of relatively large mother boards 48 and 49 are interconnected by series of hinge connectors 50 along one edge. Separate daughter boards 54 are likewise coupled to intermediate points in each of the mother boards by other hinge connections. Thus the lower mother board 49, by way of example, has a pair of smaller daughter boards 54, 55 mounted on its lower side by hinge connectors 57, 58 respectively. The mother board 48 has a group of four (also shown only by way of example) daughter boards 60–63 mounted in non-interfering spaced apart positions on its upper side by hinge connectors 66–69 respectively.

By alternating the hinge connectors from end to end, an accordion hinge assembly may be provided, while with hinge connectors mounted at a like end of a series of parallel boards, all circuit boards may be opened from one end in book fashion. Other combinations and variations of these principles will suggest themselves to those skilled in the art.

The examples of FIGS. 6–8 fundamentally assume that a plurality of parallel hinge connector elements are mounted along an axis that is normal to the plane of the individual elements. Obviously, individual hinge connector halves may be mounted along a common plane and it is convenient for many purposes to have pairs of elements which lie in side-by-side relation, at a 90° angle, at a 180° angle, or at intermediate angles therebetween. These different arrangements permit easy fabrication of the connectors themselves, while retaining the advantages of easy insertion and secure locking. The hinge portion of a connector need not lie in the same plane as the base to which external circuit connection is made. For example, assuming that a central ground conductor disk has a number of radially projecting hinge connectors, external connections can be made to mating hinge connectors which lie in the same plane. In this case each connector pivots about an axis which is normal to the plane of the central disk. However, if the base of the hinge connector incorporates a 90° twist, so that the arms and tongue lie in planes that are normal to the plane of the central disk, then exterior connector halves may be inserted so that they are pivoted about hinge axes which are parallel to the plane of the common conductor. Again, simple and conventional forming operations may be utilized to impart the needed shape into the connector.

while the hermaphroditic connector providing six points of contact has great versatility and substantial economic advantages, other hinge connector arrangements may also be employed, and some variations are depicted in the succeeding Figures. One such arrangement, which is non-hermaphroditic in character but self retaining even though only two thicknesses of metal are used, is shown in FIGS. 9 and 10. A first element 70 has a pair of spaced-apart arms 72, 73 extending symmetrically (in this example) from a base 74 and being separated at the base region by an inset aperture 76 which defines spring-acting neck portions between the base 74 and the roots of the arms 72, 73. The opposed ends of the arms 72, 73 are spaced apart by a predetermined distance, in which may be inserted a spreader member 78, which may also be termed a "received element", mounted on one side of a planar second conductor half 80. The spreader member 78 in this example is an elongated element disposed along the longitudinal axis of the second connector half 80, configured to pass between the open end defined by the arms 72, 73 of the opposite connector half 50. The end edges of the spreader member 78 slant inwardly to a narrower base, the slanted or beveled edges 82, 83 conforming to and mating with an oppositely beveled edge 85 on the opposed inner surfaces of the arms 52, 53, which may alternatively be termed a "receiving element". The length of the spreader member 78 is slightly greater than the diameter between the inner surfaces of the opposed arms 72, 73, to provide the desired spring action with two points of contact. Retention against out-of-plane shifting is achieved in one direction normal to the common plane because the planar lower (as seen in FIGS. 9 and 10) surface of the second connector 80 fits against the opposing upper surface of the first connector half 70. When locking has been achieved by the hinging action of the connector, the beveled surface 85 and the mating surfaces 82, 83 on the spreader member 78 hold the two halves 70, 80 of the connector against out-of-plane displacement in the other direction.

It will be appreciated that the spreader member 78 need not be continuous, but need only consist of two end portions, and that these in fact can be provided by a piercing die which punches and bends out cantilevered portions of the base 80. It will also be appreciated that the interior beveled edge 85 of the arms 72, 73 can readily be fabricated by a coining operation. If the two connector halves 70, 80 are to be secured in place between opposed spaced-apart surfaces of an insulator structure, then coplanar retention is not required, and the hinge connector stays in position by virtue of the exterior restraint.

Because the arms 72, 73 are symmetrical, the spreader member 78 and the second connector half 80 may be pivoted in either direction when inserted, thus enabling the angle between the halves 70, 80 to be adjusted at least ±90°. Because the connector is only two sheets of material thick, and each half lies essentially in its own plane (except for the spreader member 78), there is no interference and the hinging action can be over a substantially greater angle than 90° in each direction. It will also be noted that the spreader member can comprise a tongue with three point contact as previously described, but that the base of the connector half should include some portion fitting against the deflectable arms 72, 73, or that side guides should be used.

Figure 11:
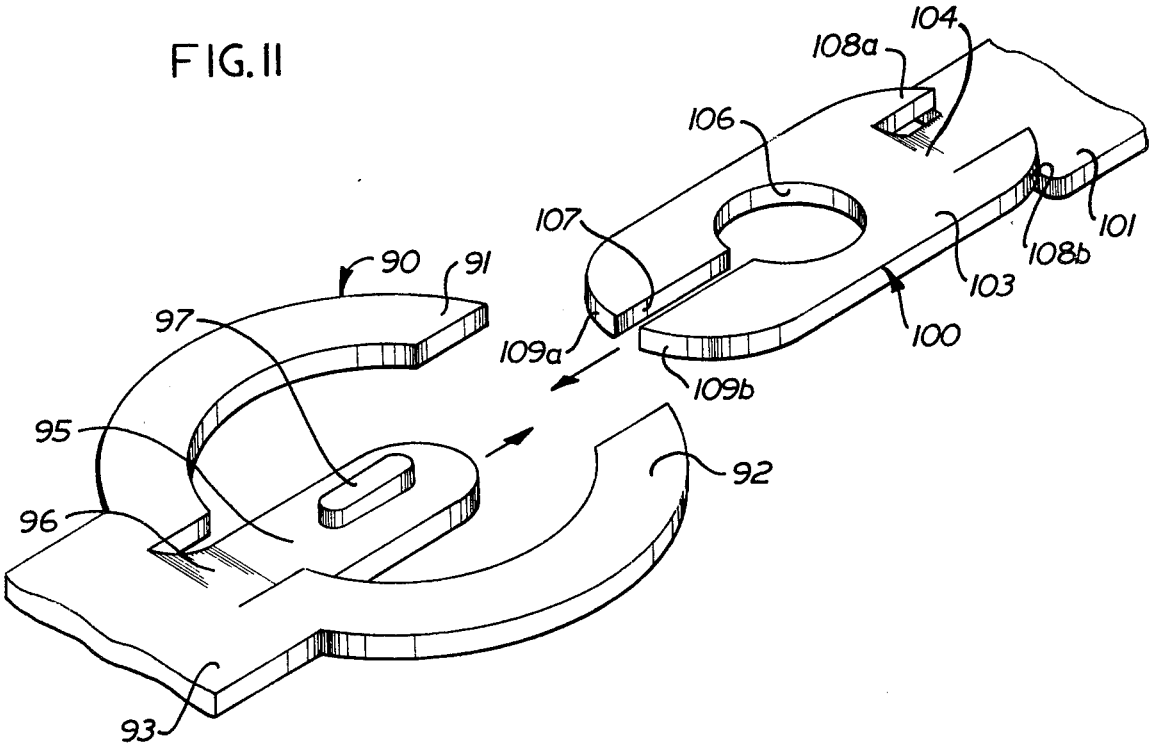
FIG. 11 is a perspective exploded view of a different connector in accordance with the invention.
Figure 12:
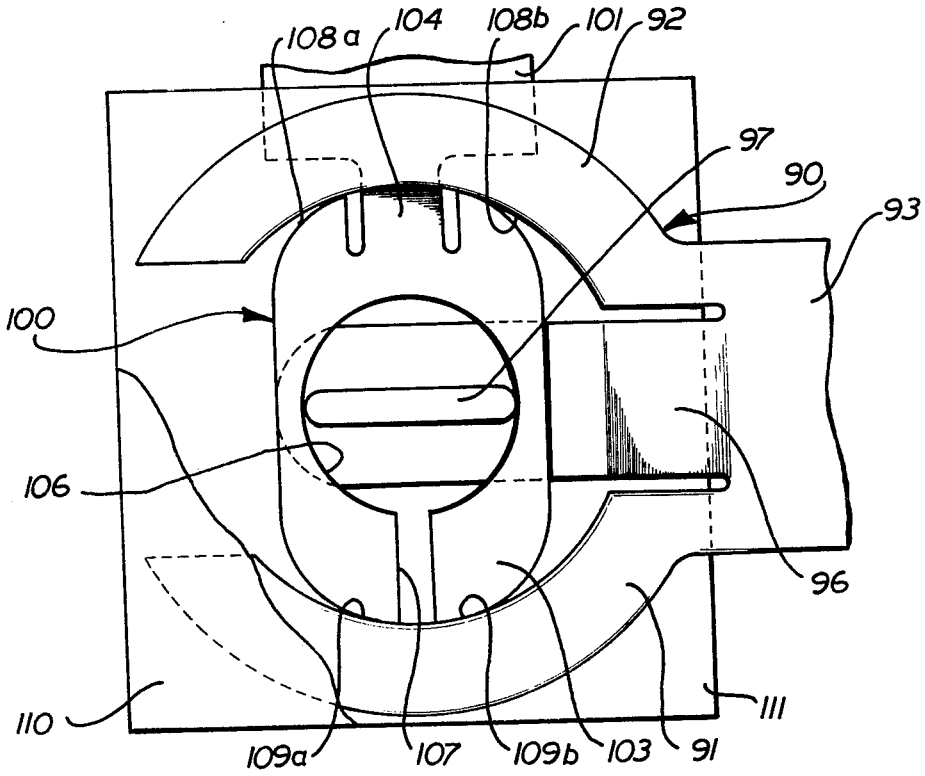
FIG. 12 is a plan view of the connector element of FIG. 11, shown in engaged position.

The connector illustrated in FIGS. 11 and 12 depicts another arrangement in accordance with the invention and provides five edge contact points and secure locking action, with the option of hinging movement in either direction. A first connector half 90 has a pair of symmetrical arms 91, 92 extending from a base 93 and having like interior edge peripheries on the arms. A tongue 95 is displaced into the adjacent thickness plane by an offset portion 96, but this tongue does not serve as the spreader member in the fashion of the arrangement of FIGS. 1–5. Instead, an elongated spreader member 97 is mounted on the tongue 95 and positioned in the principal plane of the arms 91, 92. The second half 100 of the connector has a base portion 101 to which a tongue 103 that is to lie in the plane of the arms 91, 92 is coupled by an angled offset portion 104. The tongue 103 is receivable between the spaced apart ends of the arms 91, and seats when pivoted into position between the inner periphery of the arms. The tongue also has an interior aperture 106 configured to receive the spreader member 97 in mating fashion, and a forward slot 107 disposed along the longitudinal axis and through which the spreader member 97 may slide. Thus the tongue 103 defines a pair of arms having rear contact regions **108*a* and 108*b* and front contact regions 109*a* and 109*b***.

As seen only in FIG. 12, the connector halves 90, 100, are disposed, when in operative relation, between a pair of spaced apart insulative guide elements 110, 111 which have a spacing substantially equal to two thicknesses of the material. Obviously, one of the connector halves may be embedded in or attached to one of the guide surfaces. In this example of a connector, the spreader member 97 acts to deflect the arms of the tongue 103 outwardly, engaging the four contact points 108*a*, 108*b*, 109*a*, 109*b* to the opposing interior peripheries of the arms 91, 92 of the other connector half 90. The deflection of these arms 91, 92 provides an additional spring reaction force to insure solid edge contact. Thus the contact between the two ends of the spreader member 97 and the interior edge defined by the aperture 106 in the tongue 103, and the four contact points between the tongue 103 and the arms 91, 92, provide the desired six points of edge contact. It should be noted that the spreader member 97 can be coupled or fabricated in various fashions, including being stamped or formed as an integral part of the tongue.

The arrangements of FIGS. 9–12 enable circuit connections to be made with the connector elements shifted 90° in either direction relative to each other. Such configurations therefore uniquely enable circuit boards to be opened to an access position at which circuits and circuit elements are both accessible and under energizing voltage, while in normal position the circuit boards can be densely packed.

While there have been described above and illustrated in the drawings various forms and modifications of connectors in accordance with the invention, it will be appreciated that the invention is not limited thereto but encompasses all modifications and expedients within the scope of the appended claims.

What is claimed is:

1. A zero insertion force electrical connector comprising:

a pair of thin essentially planar elements engageable together along a selected axis to an inserted position, and including an interior spreader member on a first element disposed when in the inserted position between opposed coplanar receiving arms on the second element, the spreader member lying in the same plane as the receiving arms and being pivotable relative thereto about an axis normal to the plane, the outside periphery of the spreader member engaging the interior and opposing receiving arms in edge contact relation when pivoted relative thereto from the inserted position, and the second element being configured to provide spring force resistance against the action of the spreader member, whereby the two elements may be coupled together along the selected axis with minimum force and at least one may be pivoted relative to the other to an engaged position having at least two regions of edge contact maintained under pressure.

2. The invention as set forth in claim 1 above, wherein said first element includes base means coupled to the spreader member and disposed in the adjacent thickness plane, for supporting the spreader member without interference with the pivoting motion.

3. The invention as set forth in claim 2 above, including in addition means cooperating with said first and second elements for maintaining the planar relationship of the spreader member and receiving arms during insertion and pivoting.

4. The invention as set forth in claim 3 above, wherein the spreader member and receiving arms have opposed substantially parallel edges for guiding the elements into engagement during insertion.

5. The invention as set forth in claim 4 above, wherein the spreader member has at least one width dimension centered about the selected axis during insertion that is greater than the spacing between opposed surfaces of the receiving arms between regions centered about a line transverse to the selected axis wherein the spreading action is achieved when relative pivoting is provided.

6. The invention as set forth in claim 5 above, wherein the second element has a planar base coupled to the coplanar receiving arms at root portions lying in the same plane, the root portions being deflectable within the plane to provide high spring force with low deflection such that the second element is not significantly stressed during engagement despite a secure locking action.

7. The invention as set forth in claim 6 above, wherein the two elements when engaged occupy no more than two adjacent thicknesses of material.

8. The invention as set forth in claim 7 above, wherein the elements are hermaphroditic in character and each includes a planar spreader member and opposed coplanar receiving arms.

9. The invention as set forth in claim 8 above, wherein the receiving arms have asymmetric receiving surfaces and each spreader member is configured to engage the receiving arms at three regions of edge contact, such that the connector provides a total of six regions of contact maintained under pressure.

10. The invention as set forth in claim 7 above, wherein the opposing edge surfaces of the spreader member and the receiving arms are beveled in a direction to limit displacement of one element relative to the other in one direction along an axis normal to the plane of the elements, and wherein the base of the first element lies flush against the second element to limit displacement in the opposite direction.

11. The invention as set forth in claim 7 above, wherein the first element also includes a pair of opposed coplanar receiving arms in the plane of the spreader member and configured to receive the arms of the second element and be deflected outwardly thereby in response to the spreading action of the spreader member on the arms of the first element.

12. An electrical connector comprising a pair of sheet elements, at least one of which has spaced apart spreadable conductive arms lying in a principal plane and at least the second of which has a conductive member insertable between the spreadable arms and pivotable therein when inserted, the insertable member being configured to be received between the arms in coplanar relation and to engage the arms with edge contact and deflect the arms in the principal plane of the element when pivoted through a selected angle.

13. The invention as set forth in claim 12 above, wherein each element comprises a base for connection to electrical conductors, and the spreadable arms define a U-shaped configuration, and wherein the insertable member is coupled to the base of the second element and offset therefrom into a parallel adjacent plane.

14. An electrical connector comprising a pair of essentially planar elements, a first of which includes deflectable arms and the second of which includes a portion insertable within the deflectable arms in coplanar relation, the insertable portion having an outline and sizing relative to the arms such that upon pivotable motion about an axis normal to the plane thereof the insertable portion deflects the arms outwardly to provide edge contact between the insertable portion and the arms.

15. The invention as set forth in claim 14 above, including in addition means associated with said elements for maintaining the insertable portion in position between the arms along an axis normal to the plane of the members.

16. The invention as set forth in claim 15 above, wherein each of the elements has deflectable arms and an insertable portion, the insertable portion being offset to an adjacent plane, and the essentially planar elements being interlocked with the insertable portion of one disposed between the arms of the other.

17. The invention as set forth in claim 15 above, wherein said means for maintaining said elements in position comprises mating beveled edges on the insertable portion and the opposed surfaces of the arms.

18. A zero insertion force electrical connector comprising:

a pair of conductor elements each having a thin planar base for circuit connection to associated equipment, and each including a pair of spaced-apart thin planar arms extending from the base and lying in a first plane therewith, the junctions between the base and the arms offering spring resistance against a spreading force acting within the plane of an element, the conductor elements each further including a spreader member extending from the base and disposed between the arms of the opposite element, the spreader member lying in a second plane adjacent to the first for that element, the spreader member of each element fitting between and lying in the plane of the arms of the other element, and each being of a size and shape to engage the inner periphery of the arms of the other element when one element is pivoted in its plane relative to the other, such that the spreader members engage the inner peripheries of the opposing arms at at least two points to tend to urge the arms apart against the spring resistance afforded by the junction between the base and the respective arms.

19. The invention as set forth in claim 18, above, wherein each spreader member has at least two points of contact with the opposing arms.

20. The invention as set forth in claim 19 above, wherein the arms and spreader members are planar elements integral with the base and the connector elements are metal sheet elements, of the order of at least 0.015" in thickness, and wherein the connector has a total thickness approximately equal to two thicknesses of material.

21. The invention as set forth in claim 20 above, wherein each spreader member contacts the opposing arms at three spaced apart contact points, and wherein the roots of the arms serve as deflectable spring regions that deflect in the plane of the elements.

22. The invention as set forth in claim 21 above, wherein the spreader members have convex outer peripheries and one arm has a substantially straight inner edge while the other has a concave inner edge.

23. A zero insertion force electrical connector comprising a pair of thin essentially planar elements defining a two thickness structure, the elements being slidably engageable into mating side-by-side relation with a received portion of each lying coplanar with and extending into contact with a receiving portion of the other along edges thereof, and being pivotable relative to each other to a locking and contacting position in which the received portion acts against the edges of the receiving portion.

24. An electrical connector comprising:

a pair of mating conductor elements, each including means defining an inner periphery in one plane and a side opening thereto in the same plane, and a centrally disposed member in an adjacent parallel plane, each centrally disposed member fitting within the side opening of the other element, and at least one of the elements being pivotable about an axis transverse to the planes to engage the outer edge of each centrally disposed member against the inner periphery of the other element.

25. The invention as set forth in claim 24 above, wherein said mating conductor elements comprise a pair of essentially planar elements, each having double arms defining an inner edge contact surface and an intermediate tongue in an adjacent plane, the tongue of one being insertable within the arms of the other and rotatable within the planes of the elements to an edge contact position.

26. The invention as set forth in claim 25 above, wherein the arms are asymmetrical, with one having a straight and the other having a convex inner side.

27. The invention as set forth in claim 26 above, wherein the mating conductor elements are alike, such that the connector is a hermaphroditic connector, and wherein the intermediate tongues have three points of contact with the opposing arms.

28. An electrical connector comprising:

a pair of essentially planar conductor elements, at least one of which is receivable within a portion of the other in coplanar relation, the receiving element having a pair of spaced apart deflectable portions in a given plane defining an interior opening, and the received element being pivotable about an axis normal to the given plane when in the received position, and including a received portion disposed within the interior opening and engaging the deflectable portions in edge contact relation within the given plane when pivoted.

29. The invention as set forth in claim 28 above, wherein the conductor elements are of like size and shape, and wherein the received portions comprise individual tongue members offset into an adjacent thickness plane from the given plane of the deflectable portions.

30. The invention as set forth in claim 29 above, wherein the elements each comprise a base, and the deflectable portions comprise a pair of arms extending from the base along a longitudinal axis, and separated at spaced apart ends, and wherein the tongue members may be inserted between the spaced apart ends and pivoted about an axis within the arms to provide at least two points of edge contact therewith.

31. The invention as set forth in claim 30 above, wherein the arms have asymmetrical inner edges, and wherein each tongue member engages the opposed arms at three points of contact.

32. The invention as set forth in claim 28 above, wherein the pair of elements are of dissimilar shape, wherein the receiving element comprises a pair of symmetrical arms and the received element comprises a spreader member.

33. The invention as set forth in claim 32 above, wherein the receiving element and received element have mating angled edges that retain the elements in position against movement along the pivot axis.

34. The invention as set forth in claim 32 above, wherein the received element comprises a pair of spaced apart projecting edges providing two points of contact with the opposed arms.

35. An electrical connector comprising:

a pair of essentially planar conductor elements, at least one of which is receivable within a portion of the other in coplanar relation, the receiving element having a pair of spaced apart deflectable portions in a given plane;

the received element being pivotable about an axis normal to the given plane when in the received position, and comprising a spreader member disposed intermediate the deflectable portions of the receiving element and engaging the deflectable portions in edge contact relation within the given plane when pivoted, and the received element further including deflectable means defining an aperture for receiving the deflectable portions of the receiving element, such that the spreader member when pivoted urges the deflectable portions of the receiving element in turn against the deflectable means of the received element.

36. The invention as set forth in claim 35 above, wherein the receiving element comprises a tongue portion having a central aperture and an end slot defining a pair of elongated deflectable segments, and the deflectable portions of the received element comprise a pair of spaced apart arms, the spreader member of the received element when pivoted engaging interior edges of the deflectable segments and the exterior edges of the deflectable segments engaging the interior edges of the arms of the received element.

37. The invention as set forth in claim 36 above, wherein the spreader member engages the deflectable segments at two points of contact and the deflectable segments engage the arms at four points of contact.

* * * * *